US008870722B2

(12) United States Patent
Kassel

(10) Patent No.: US 8,870,722 B2
(45) **Date of Patent: *Oct. 28, 2014**

(54) RESISTANCE TRAINING EXERCISE AND FITNESS APPARATUS WITH ATTACHMENT DEVICE

(75) Inventor: Blake Kassel, Boca Raton, FL (US)

(73) Assignee: Bodylastics International, Inc., Boca Raton, FL (US)

( * ) Notice: Subject to any disclaimer, the term of this patent is extended or adjusted under 35 U.S.C. 154(b) by 694 days.

This patent is subject to a terminal disclaimer.

(21) Appl. No.: 12/928,786

(22) Filed: Dec. 20, 2010

(65) Prior Publication Data

US 2011/0092347 A1 Apr. 21, 2011

Related U.S. Application Data

(63) Continuation-in-part of application No. 12/804,584, filed on Jul. 26, 2010, now abandoned, which is a continuation-in-part of application No. 12/546,085, filed on Aug. 24, 2009, now Pat. No. 7,819,787, which is a continuation-in-part of application No. 12/344,798, filed on Dec. 29, 2008, now Pat. No. 7,785,243.

(51) Int. Cl.

| | |
|---|---|
| ***A63B 21/02*** | (2006.01) |
| ***A63B 21/00*** | (2006.01) |
| ***A63B 23/035*** | (2006.01) |
| ***A63B 21/16*** | (2006.01) |
| *A63B 21/055* | (2006.01) |
| *A63B 21/04* | (2006.01) |

(52) U.S. Cl.

CPC ..... *A63B 21/0552* (2013.01); *A63B 21/1403* (2013.01); *A63B 23/03575* (2013.01); *A63B 21/0555* (2013.01); *A63B 21/1663* (2013.01); *A63B 21/143* (2013.01); *A63B 21/0442* (2013.01); *A63B 21/1438* (2013.01); *A63B 21/0557* (2013.01); *A63B 23/0355* (2013.01)

USPC ..... 482/122; 482/121; 482/126

(58) Field of Classification Search

USPC ..... 482/121–129, 904; 113/769–770, 792, 113/798; 24/300

See application file for complete search history.

(56) References Cited

U.S. PATENT DOCUMENTS

| | | | | |
|---|---|---|---|---|
| 1,112,114 A | | 9/1914 | Caines | |
| 1,538,845 A | * | 5/1925 | Titus | 482/126 |
| 4,815,731 A | * | 3/1989 | Suarez et al. | 482/124 |
| 5,052,365 A | | 10/1991 | Carella | |
| 5,167,601 A | * | 12/1992 | Frappier | 482/121 |
| 5,743,838 A | | 4/1998 | Willis | |

(Continued)

*Primary Examiner* — Stephen Crow

(74) *Attorney, Agent, or Firm* — Caesar, Rivise, Bernstein, Cohen & Pokotilow, Ltd.

(57) ABSTRACT

A resistance exercise apparatus is provided, the apparatus comprising: a stretchable cord having opposing first and second ends, the cord having an internal cavity and an external surface; at least one plug being inserted within the internal cavity of the cord adjacent the first end of the cord; at least one sleeve being placed over the external surface of the cord adjacent the first end of the cord, the plug being situated within a length of the sleeve; at least one tether forming two compartments, a first loop compartment is designed to received at least one end of the cord with at least a portion of the sleeve and at least a portion of the plug; and at least one attachment device, at least a portion of the attachment device being designed to be received within at least a portion of the second compartment of the tether.

12 Claims, 18 Drawing Sheets

(56) References Cited

U.S. PATENT DOCUMENTS

| | | | | |
|---|---|---|---|---|
| 5,800,322 | A | 9/1998 | Block | |
| 5,807,218 | A | 9/1998 | Nagatomo | |
| 6,202,263 | B1 | 3/2001 | Harker | |
| 6,402,668 | B1 | 6/2002 | Harker | |
| 6,524,226 | B2 | 2/2003 | Kushner | |
| 6,692,415 | B1 | 2/2004 | Winston | |
| 6,860,841 | B1 | 3/2005 | Mortorano | |
| 6,979,286 | B1 | 12/2005 | Hinds | |
| 7,004,892 | B2 * | 2/2006 | Marco | 482/124 |
| 7,041,040 | B2 | 5/2006 | Dovner et al. | |
| 7,044,896 | B2 | 5/2006 | Hetrick | |
| 7,090,622 | B2 | 8/2006 | Hetrick | |
| 7,326,157 | B2 | 2/2008 | Wu | |
| 7,344,485 | B1 | 3/2008 | Simpson et al. | |
| 7,357,762 | B1 | 4/2008 | Terry et al. | |
| 7,418,926 | B2 | 9/2008 | Kung | |
| 7,448,990 | B2 | 11/2008 | Wu | |
| 7,455,632 | B2 | 11/2008 | Block et al. | |
| 7,458,135 | B2 | 12/2008 | Mikesell et al. | |
| 7,503,883 | B2 | 3/2009 | Madden | |
| 7,727,131 | B2 * | 6/2010 | Longo | 482/124 |
| 7,785,243 | B2 * | 8/2010 | Kassel | 482/122 |
| 7,819,787 | B2 * | 10/2010 | Kassel | 482/122 |
| 2003/0045408 | A1 | 3/2003 | Seles | |
| 2004/0180767 | A1 | 9/2004 | Carmel et al. | |
| 2005/0137066 | A1 | 6/2005 | Wu | |
| 2006/0073954 | A1 | 4/2006 | Block et al. | |
| 2007/0101950 | A1 | 5/2007 | Medlin | |
| 2007/0207904 | A1 | 9/2007 | Wu | |
| 2011/0224055 | A1 * | 9/2011 | Kassel | 482/121 |

* cited by examiner

RESISTANCE TRAINING EXERCISE AND FITNESS APPARATUS WITH ATTACHMENT DEVICE

RELATED APPLICATIONS

This application is a continuation-in-part of U.S. Ser. No. 12/804,584 filed Jul. 26, 2010 now abandoned entitled "Resistance Training Exercise And Fitness Device", which is a continuation-in-part of U.S. Ser. No. 12/546,085 filed Aug. 24, 2009 now U.S. Pat. No. 7,819,787 entitled "Resistance Training Exercise Device, System & Method", which has now been granted a Notice of Allowance and is a continuation-in-part of U.S. Ser. No. 12/344,798 filed Dec. 29, 2008 entitled "Resistance Training Exercise Device, System & Method" which has now issued as U.S. Pat. No. 7,785,243. The disclosure of the above application is incorporated herein by reference.

STATEMENT REGARDING FEDERALLY SPONSORED RESEARCH OR DEVELOPMENT

N/A

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office patent file or records, but otherwise reserves all copyrights rights whatsoever.

BACKGROUND OF THE INVENTION

1. Field of the Invention

This invention relates generally to a resistance training exercise and fitness device, and more particularly, to a resistance training exercise device and method employing a governor system which strengthens the flexibility and elasticity of the device and prevents snapping or breaking of the cord.

2. Description of the Background Art

Resistance training is a popular form of exercise. Resistance training exercise devices known consist of a stretchable tube or cord with a pair of handles secured to opposing ends of the tube. To use this type of device, the user holds the handles and repeatedly stretches the tube, increasing the tension force in the tube, and retracts the tube while maintaining tension in the tube. However, resistance training devices such as these are very limited in application and structure and tend to break when stretched beyond the cord's capacity.

The present invention provides for a resistance training exercise cord device and system that accommodated the universal use of a plurality of different handles and straps with interchangeable elastic cords of varying levels of elasticity to change the work load and with a non-obstructive mechanism for limiting the length of the stretch to prevent the cord from breaking or snapping.

SUMMARY OF THE INVENTION

In light of the foregoing, in one embodiment, the present invention relates to a resistance training cord device having a plurality of interchangeable handles and straps.

In another embodiment, the present invention also relates to a resistance training elastic cord device having a tethered clip for interchanging handles, straps, bars, ropes and, or other components.

In yet another embodiment, the present invention provides for a resistance training elastic cord device having a clip tethered at each end of the cord for interchanging handles and straps.

In still another embodiment, the present invention relates to a resistance training elastic cord device having a clip tethered to each end of the cord by a structurally reinforced tether secured to each end of the cord.

In still yet another embodiment, the invention also relates to a resistance training elastic cord system having a plurality of interchangeable cords of varying elasticity, handles and straps.

In a further embodiment, the present invention provides for a method for using the resistance training elastic cord system for providing resistance exercise to enhance muscle strength and tone.

In yet a further embodiment, the present invention relates to a resistance training elastic cord device and system that is cost effective and convenient to use.

In still a further embodiment, the present invention provides for a resistance training elastic cord device having a limit mechanism that prevents stretching the device beyond a certain distance so it does not break.

In another further embodiment, the present invention further provides for a resistance training elastic cord device having a limit mechanism that does not interfere with a workout or result in a bulky device.

The instant invention provides a resistance training exercise device, system and method comprising at least one elastic, elongated and hollow cord with a tether secured to each end of the cord and a clip secured to the free end of the each tether. The cord comprises a rubber or rubber like material having a predetermined level of elasticity. It is the level of elasticity that dictates the tension force of the cord in pounds. Accordingly, the cord is assigned an average workout weight in pounds, which is marked on the cord's corresponding clip. Each tether is secured to its respective end of the cord by a grommet, plug and sleeve. The plug is inserted in each cord end to prevent the grommet from slipping off the cord. The sleeve fits around the plug and the end of the cord containing the plug. The sleeve may comprise a separate component or the end of the cord folded back over itself and the plug. The clips comprise an o-ring that receives the free end of the tether and a spring-loaded biasing flange for clipping onto a handle, strap or the cord itself. The handles and straps each comprise an o-ring for clasping by the clip. The handles are covered with foam for comfort. Likewise, the straps are padded for comfort.

In an alternative embodiment, the resistance training exercise device comprises a limit mechanism secured inside the elastic cord to prevent the cord from being stretched beyond a certain distance. The limit mechanism or band comprises a thin fabric or semi-elastic material having less elasticity or being substantially inelastic to stop the cord from stretching beyond the length of the band or predetermined point. The limit band has some elasticity, but less than the cord, so it does not bunch up in a relaxed cord. The limit band also has a higher tensile strength than the elastic cord.

The system of the instant invention comprises a plurality of cords with a clip tethered to each end, plurality of handles, and plurality of ankle or wrist straps. Each cord comprises a different level of elasticity or tension force measured in pounds for facilitating a desired workout. Each cord is color coded to indicate the "weight" of the cord. The system of the instant invention may further comprise a travel bag, user manual, workout guide and, or training video or DVD.

The method of resistance training in accordance with the instant invention comprises various exercises utilizing one or more cords and one or more handles or straps. The handles are used for stretching the cord with the hands. The straps are mounted to the wrists, ankles or stationary objects for stretching the cord. The user first determines the exercise to be performed. The user may reference the manual and guide for determining and designing exercise routines. Based on the exercise, the appropriate cord and handles or straps are selected and clipped to the tether or a clip may be clipped to the cord. Once the cord is properly prepared, a variety of exercises may be performed by stretching the cord and slowing the retraction of the cord to controllably release tension. For instance, the user may grasp a handle with each hand and stretch and slowly retract the cord across the chest, or stand in the middle of the cord and stretch the cord upward and outward. The user may clip one end of the cord to a door handle or hook and grasp a handle at the other end with one hand for repeatedly stretching the cord by pulling outward. The user may clip one end of the cord to a door handle or door anchor device and secure an ankle strap to the cord at the other end and place it around an ankle for repeatedly stretching the cord by moving the leg outward. The cord may be secured to a stationary object at one end by wrapping it around the stationary device and clipping it to itself.

In one embodiment, the present invention provides for an exercise device comprising: a stretchable cord having opposing first and second ends, the cord has an internal cavity and an external surface; at least two plugs, each plug is inserted within the internal cavity of the cord adjacent the first and second ends of the cord; at least two sleeves, each of the sleeves being placed over the external surface of the cord adjacent the first and second ends of the cord, each of the plugs is situated within a length of each of the sleeves; at least two tethers, each of the tethers has a stitched portion, the stitched portion forming two opposing compartments, a first compartment having at least one grommet and is designed to received at least one end of the cord with the sleeve and the plug, the grommet has a circumference that is smaller than a circumference of the cord with the sleeve, and the plug with at least a portion of the cord and at least a portion of the sleeve is situated generally within the first compartment of the tether; at least two carabineers, each of the carabineers has a bottom portion and a gate element; and at least two O-rings situated within each of the bottom portions of each of the carabineers, each of the O-rings is designed to receive a portion of the second compartment of each of the tethers.

In another embodiment, the present invention relates to a resistance exercise device comprising: a stretchable cord having opposing first and second ends, the cord has an internal cavity and an external surface; at least one plug is inserted within the internal cavity of the cord adjacent the first end of the cord; at least one sleeve is placed over the external surface of the cord adjacent the first end of the cord, the plug is situated within a length of the sleeve; at least one tether having a stitched portion, the stitched potion forms two opposing compartments, a first compartment has at least one grommet and is designed to received at least one end of the cord with the sleeve and the plug, the plug with at least a portion of the cord and at least a portion of the sleeve is situated generally within the first compartment of the tether, the second compartment forms a loop; at least one carabineer has a bottom portion and a gate element; and at least one O-ring is situated within the bottom portion of the carabineer, the O-ring is designed to receive a portion of the loop of the second compartment of the tether.

In a further embodiment, the present invention relates to a resistance exercise device comprising: a stretchable cord has opposing first and second ends, the cord has an internal cavity and an external surface, each of the first and second ends is folded over itself to create double layered ends; at least one plug is inserted within the internal cavity of the cord adjacent the first end of the cord, the plug is situated within a length of the double layered cord; at least one tether has a stitched portion, the stitched potion forms two opposing compartments, a first compartment has at least one grommet and is designed to received at least one end of the cord with the plug, the plug with at least a portion of the cord and at least a portion of the double layered cord is situated generally within the first compartment of the tether, the second compartment forms a loop; at least one carabineer has a bottom portion and a gate element; and at least one O-ring is situated within the bottom portion of the carabineer, the O-ring is designed to receive a portion of the loop of the second compartment of the tether.

In still another embodiment, the present invention provides for an exercise device comprising: a stretchable cord having opposing first and second ends, the cord having an internal cavity and an external surface; at least two sleeves, each of the sleeves being placed over the external surface of the cord adjacent the first and second ends of the cord, each of the plugs being situated within a length of each of the sleeves; at least two tethers, each of the tethers has a stitched portion, the stitched potion forms two opposing compartments, a first compartment has at least one grommet and is designed to received at least one end of the cord with the sleeve, the grommet has a circumference that is smaller than a circumference of the cord with the sleeve, at least a portion of the cord and at least a portion of the sleeve are situated generally within the first compartment of the tether; at least two carabineers, each of the carabineers has a bottom portion and a gate element; at least one limit band situated within the internal cavity of the cord; and a means for securing the limit band within the internal cavity of the cord, the means is situated within the cord and the sleeve.

In yet another embodiment, the present invention relates to a resistance exercise device comprising: a stretchable cord having opposing first and second ends, the cord has an internal cavity and an external surface; at least one plug is inserted within the internal cavity of the cord adjacent the first end of the cord; at least one sleeve is placed over the external surface of the cord adjacent the first end of the cord, the plug is situated within a length of the sleeve; at least one tether has a stitched portion, the stitched potion forms two opposing compartments, a first compartment has at least one grommet and is designed to received at least one end of the cord with the sleeve and the plug, the plug with at least a portion of the cord and at least a portion of the sleeve is situated generally within the first compartment of the tether, the second compartment forms a loop; at least one carabineer having a bottom portion and a gate element; and at least one limit band is situated within the internal cavity of the cord, the limit band has opposing ends, at least a portion of the first end of the limit band is secured to the plug.

In still yet another embodiment, the present invention discloses a resistance exercise device comprising: a stretchable cord having opposing first and second ends, the cord has an internal cavity and an external surface, each of the first and second ends is folded over itself to create double layered ends; at least one plug is inserted within the internal cavity of the cord adjacent the first end of the cord, the plug is situated within a length of the double layered cord; at least one tether has a stitched portion, the stitched potion forms two opposing compartments, a first compartment has at least one grommet and is designed to received at least one end of the cord with the plug, the plug with at least a portion of the cord and at least a portion of the double layered cord is situated generally within the first compartment of the tether, the second compartment forms a loop; at least one carabineer has a bottom portion and a gate element; and at least one limit band is situated within the internal cavity of the cord.

In a further embodiment, the present invention teaches a resistance exercise device comprising: a stretchable cord having opposing first and second ends, the cord has an internal cavity and an external surface; at least two sleeves, each of the sleeves is placed over the external surface of the cord adjacent the first and second ends of the cord, each of the plugs is situated within a length of each of the sleeves; at least two tethers, each of the tethers has a stitched portion, the stitched potion forms two opposing compartments, a first compartment has at least one grommet and is designed to received at least one end of the cord with the sleeve, the grommet has a circumference that is smaller than a circumference of the cord with the sleeve, at least a portion of the cord and at least a portion of the sleeve are situated generally within the first compartment of the tether; at least two carabineers, each of the carabineers has a bottom portion and a gate element; and at least one limit band is situated within the internal cavity of the cord, the limit band has opposing ends, at least one end of the limit band is attached to the bottom portion of one of the carabineers.

In one embodiment, the present invention provides for a exercise device comprising: a stretchable cord having opposing first and second ends, the cord having an internal cavity and an external surface; at least two plugs, each plug being inserted within the internal cavity of the cord adjacent the first and second ends of the cord; at least two sleeves, each of the sleeves being placed over the external surface of the cord adjacent the first and second ends of the cord, each of the plugs being situated within a length of each of the sleeves; at least two tethers, at least a portion of each of the tethers being closed thereby forming at least two opposing compartments, a first compartment having at least one grommet and is designed to received at least one end of the cord with the sleeve and the plug, the plug with at least a portion of the cord and at least a portion of the sleeve being situated generally within the first compartment of the tether; and at least two carabineers, each of the carabineers having a bottom portion and a gate element, the bottom portion of each of the carabineers is designed to receive a portion of the second compartment of each of the tethers.

In another embodiment, the first and second compartments of the tether form loops having an internal diameter, and the diameter of the first compartment is larger than the diameter of the second compartment.

In yet another embodiment, each of the bottom portions of the carabineer having a closed area, the closed area of the bottom portions of the carabineers is designed to receive a portion of the second compartment of each of the tethers.

In still another embodiment, the tether is closed by a stitched portion, the stitched portion provides for reinforcement in strengthening the tether and the device when the cord is stretched. In still yet another embodiment, the sleeve, the tether with the compartments and the plug assist in preventing the cord from breaking and snapping during stretching of the cord.

In a further embodiment, the plug is situated within the first compartment of the tether and prevents the end of the cord and at least a portion of the sleeve from passing the grommet when the cord is stretched.

In another further embodiment, the diameter of the second compartment is a size that allows the loop to fit around the bottom portion of the carabineer and be a size that limits movement of the loop around the bottom portion of the carabineer.

In yet a further embodiment, the diameter of the first compartment is from about 5 to about 95% larger than the diameter of the second compartment of the tether.

In still a further embodiment, the present invention provides for a resistance exercise device comprising: a stretchable cord having opposing first and second ends, the cord having an internal cavity and an external surface; at least one plug being inserted within the internal cavity of the cord adjacent the first end of the cord; at least one sleeve being placed over the external surface of the cord adjacent the first end of the cord, the plug being situated within a length of the sleeve; at least one tether, at least a portion of the tethers being closed thereby forming at least two opposing compartments, a first compartment having at least one grommet and is designed to received at least one end of the cord with the sleeve and the plug, the plug with at least a portion of the cord and at least a portion of the sleeve being situated generally within the first compartment of the tether; and at least one carabineer having a closed bottom portion and a gate element, the closed bottom portion being designed to receive a portion of the second compartment of the tether.

In yet still a further embodiment, the device further comprises a second plug and a second sleeve, the second plug being inserted within the internal cavity of the cord adjacent the second end of the cord, the second sleeve being placed over the external surface of the cord adjacent the second end of the cord, the second plug being situated within a length of the second sleeve.

In another embodiment, the device further comprises a second tether, at least a portion of the second tether being closed thereby forming at least two opposing compartments, a first compartment having at least one grommet and is designed to received at least one end of the cord with the second sleeve and the second plug, the second plug with at least a portion of the cord and at least a portion of the second sleeve being situated generally within the first compartment of the tether, the second compartment forming a loop.

In yet another embodiment, the device further comprises a second carabineer having a closed bottom portion and a gate element, the closed bottom portion of the second carabineer being designed to receive a portion of the second compartment of the second tether.

In still another embodiment, the device further comprises an apparatus designed to be attached to the carabineer for providing multiple exercise options, the apparatus being selected from a group consisting essentially of handles, loops, straps, bands, rings, rope, grips and combinations thereof. In another further embodiment, the tether comprises straps. In a further embodiment, the device further comprises a plurality of combinable devices to form a system.

In another embodiment, the present invention relates to a resistance exercise device comprising: a stretchable cord having opposing first and second ends, the cord having an internal cavity and an external surface, each of the first and second ends being folded over itself to create double layered ends; at least one plug being inserted within the internal cavity of the cord adjacent the first end of the cord, the plug being situated within a length of the double layered cord; at least one tether having a stitched portion, the stitched potion forming two opposing compartments, a first compartment having at least one grommet and is designed to received at least one end of the cord with the plug, the plug with at least a portion of the cord and at least a portion of the double layered cord being situated generally within the first compartment of the tether, the second compartment forming a loop; at least one carabineer having a bottom portion and a gate element, the bottom portion is designed to receive a portion of the loop of the second compartment of the tether; and at least one limit band situated within the internal cavity of the cord.

In accordance with these and other embodiments, the present invention will now be described with particular reference to the accompanying drawings.

BRIEF DESCRIPTION OF THE DRAWINGS

The accompanying drawings are included to provide a further understanding of the present invention. These drawings are incorporated in and constitute a part of this specification, illustrate one or more embodiments of the present invention and together with the description, serve to explain the principles of the present invention.

Figure 1:
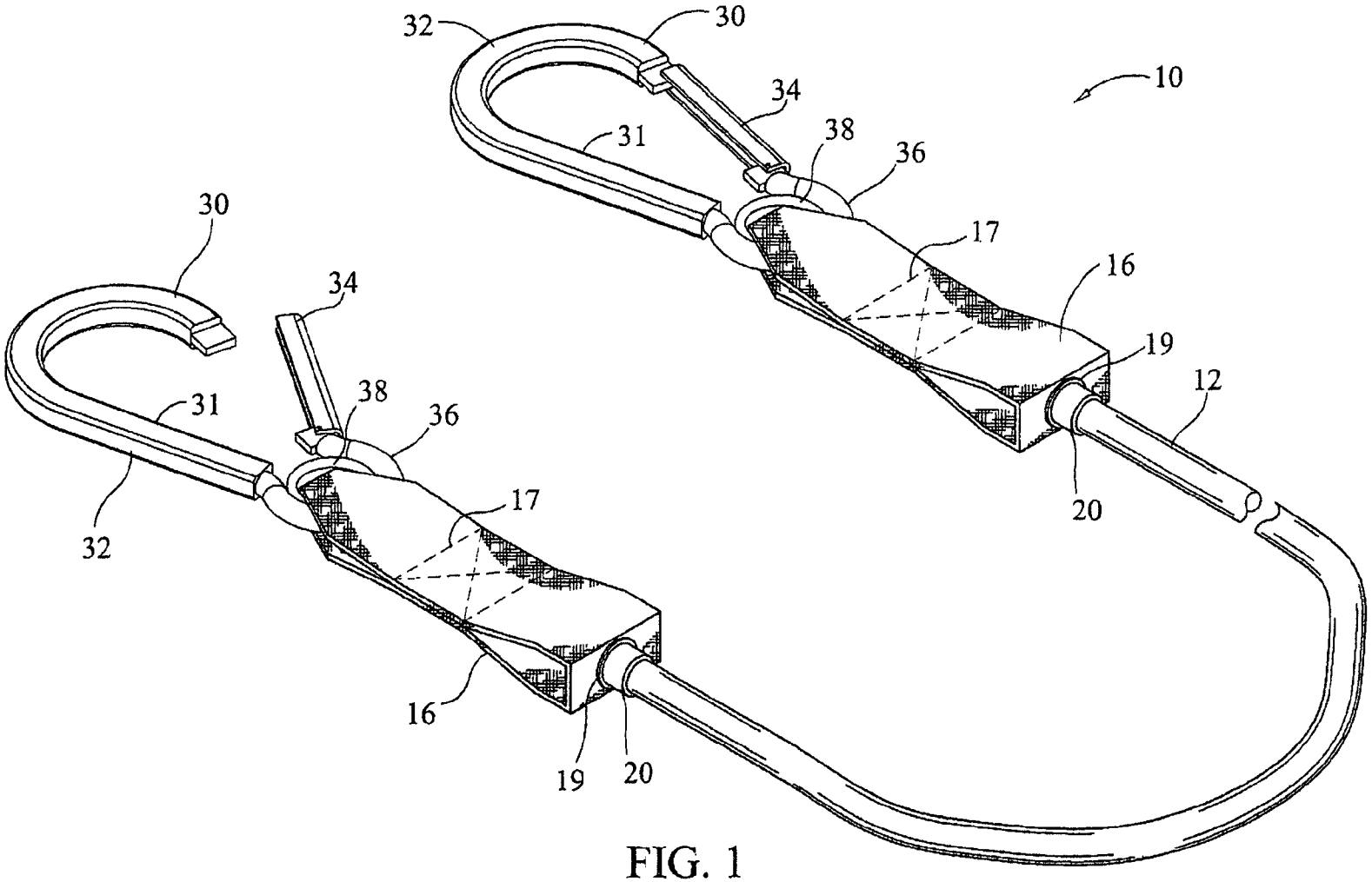
FIG. 1 is a perspective view of the resistance training exercise device in accordance with another embodiment of the instant invention.
Figure 2:
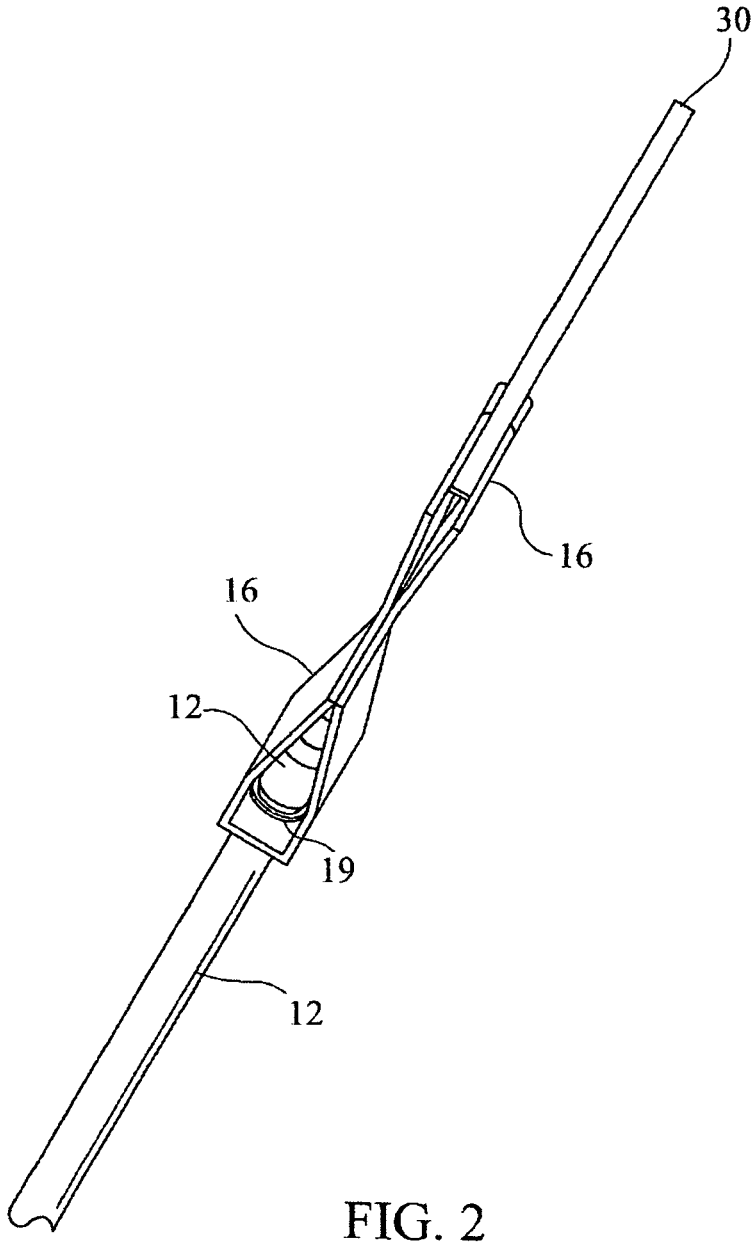
FIG. 2 is a side perspective view of the resistance training exercise device in accordance with another embodiment of the instant invention.

Among those benefits and improvements that have been disclosed, other objects and advantages of this invention will become apparent from the following description taken in conjunction with the accompanying drawings. The drawings constitute a part of this specification and include exemplary embodiments of the present invention and illustrate various objects and features thereof.

DETAILED DESCRIPTION OF THE INVENTION

As required, detailed embodiments of the present invention are disclosed herein; however, it is to be understood that the disclosed embodiments are merely exemplary of the invention that may be embodied in various forms. The figures are not necessarily to scale, some features may be exaggerated to show details of particular components. Therefore, specific structural and functional details disclosed herein are not to be interpreted as limiting, but merely as a basis for the claims and as a representative basis for teaching one skilled in the art to variously employ the present invention.

With reference to the drawings, FIGS. 1 to 21C depict various embodiments of the instant invention which is generally referenced as a resistance training exercise device, system or method and, or by numeric character 10. The instant invention 10 comprises a resistance training exercise device, system and method that enables multiple exercises by providing and facilitating use of a plurality of interchangeable cords, handles and straps.

With reference to FIG. 1-21C, various embodiments of the resistance training exercise device 10 of the instant invention comprises an elastic, elongated and hollow cord 12, a tether 16 secured to each end of the cord 12 and a clip 30 secured to the free end of each tether 16. The cord 12 comprises a rubber or rubber like material having a predetermined level of elasticity corresponding to the amount of pulling force needed to stretch the cord a certain distance. The level of elasticity resistance in the cord dictates the tension force of the cord, which is represented in pounds. Accordingly, the cord 12 is designed with an average workout weight in pounds based on the cords modules of elasticity, which is indicated on the cord's corresponding clip 30 by indicia 31. Each tether 16 preferably comprises a nylon or nylon-like material that is secured to a corresponding end of the cord 12. Each tether 16 is sewn with stitching 17 in a mid-section to form a loop at each end for receiving and holding a corresponding clip 30 end and cord end 12, respectively. A clip 30 is secured to the free end of each tether 16 for attaching to a handle 40, ankle or wrist strap 50, rope, bar or other attachment or to the cord 12. The handle 40 preferably comprises an o-ring 42 for connecting to the clip 30, a support extension 43 with a loop for receiving and containing the o-ring 42 and a foam pad 44 around the gripping portion of the handle 40. Likewise, the ankle or wrist strap 50 preferably comprises an o-ring 52 for connecting to the clip 30, a support extension 53 with a loop for receiving and containing the o-ring 52 and a padded belt 54 for receiving and engaging an ankle or wrist.

Figure 3:
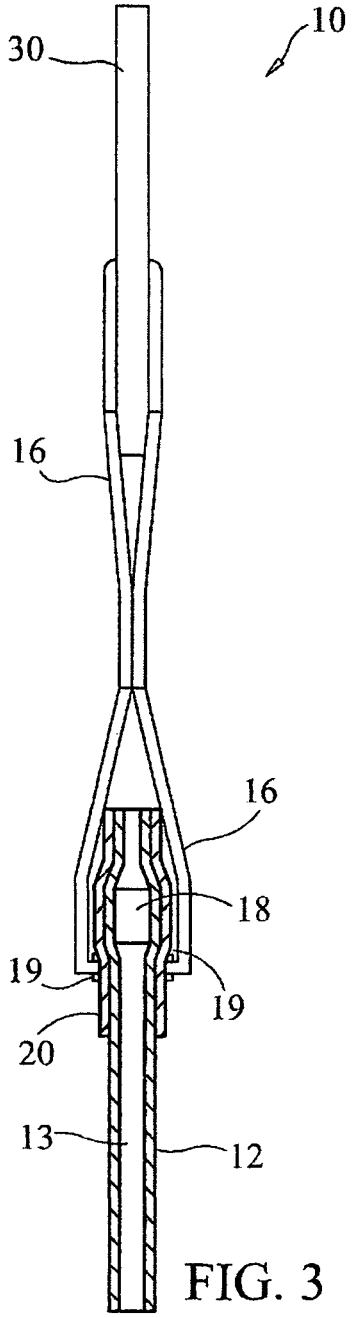
FIG. 3 is a partial cross-sectional view and elevational view of the resistance training exercise device in accordance with another embodiment of the instant invention.
Figure 4:
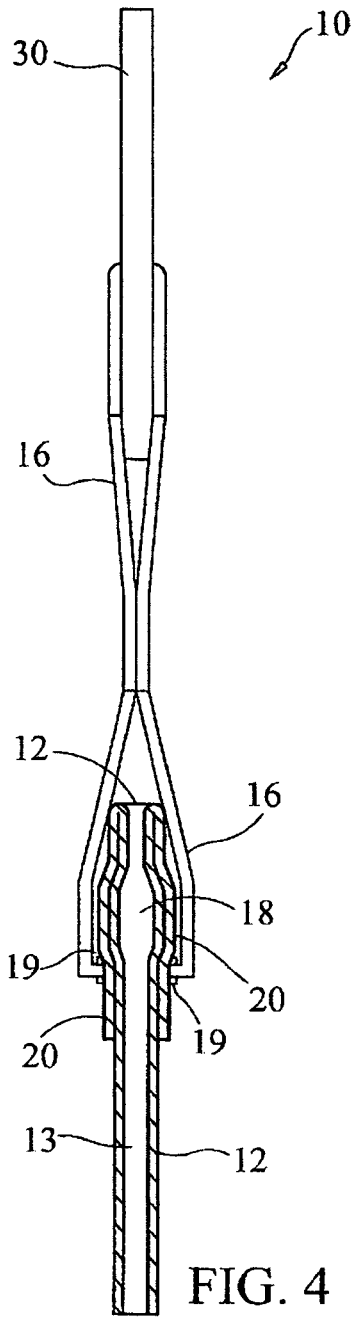
FIG. 4 is a partial cross-sectional view and elevational view of the resistance training exercise device in accordance with the alternative embodiment of the instant invention.
Figure 5:
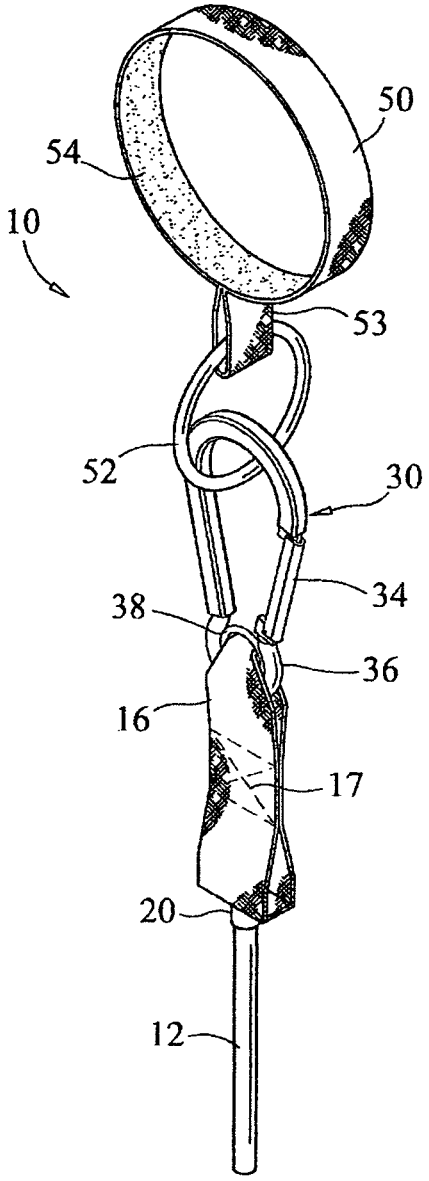
FIG. 5 is a perspective view of the resistance training exercise device with an ankle or wrist strap in accordance with another embodiment of the instant invention.
Figure 6:
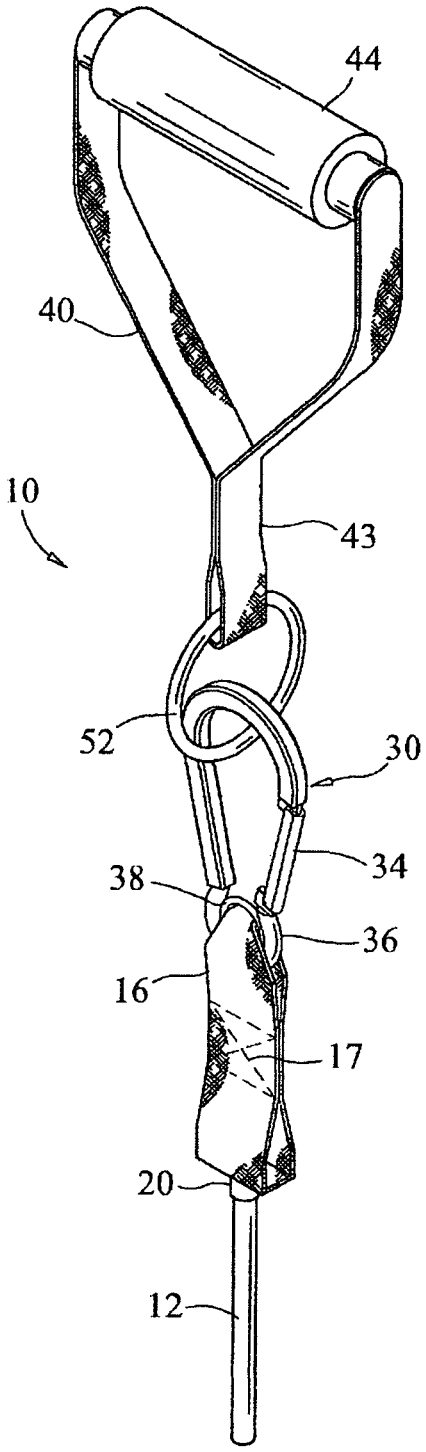
FIG. 6 is a perspective view of the resistance training exercise device with a handle in accordance with another embodiment of the instant invention.

Referring to FIGS. 3 and 4, the tethers 16 are each secured to its respective end of the cord 12 by a grommet 19, plug 18 and strain-relief sleeve 20. The plug 18 is inserted in the hollow passage 13 of each cord 12 proximal one end to block the grommet 19 from slipping off the cord. The sleeve 20 fits tightly over the end of the cord 12 containing the plug 18 to reinforce the cord 12 and plug 18 and increase its stress and strain tolerance. The sleeve 20 preferably comprises an elastic sleeve that stretches and mounts over the cord 12 segment containing the plug 18 conforming to its shape to reinforce and increase the tolerance level of stress, strain and, or sheering forces, as shown in FIG. 3. In an alternative embodiment, the sleeve 20 may be formed by and comprise a portion of the cord 12 folded back over its segment containing the plug 18 in a manner that conforms to the cord 12 and plug 18 to enhance the tolerance level of strain, stress and, or sheer forces, as shown in FIG. 4.

With reference to FIG. 1-9, the clips 30 comprise a hooked body 32, a spring-loaded or biasing member 34 pivotally secured in or over the opening of the hook body 32 to a smaller tether-connecting end 36 having an opening or aperture that receives and supports a corresponding end of the tether 16. The tether end 36 may contain an o-ring 38 in its opening that receives the same tether end for reinforcement and smooth support of the tether 16 in a manner that reduces friction and the risk of damage during exercise. Access to the opening in the clip 30 is controlled by the biasing member 34, which facilitates clipping to a handle 40 or strap 50. The handle o-ring 42 or strap o-ring 52 passes through the biasing member 34 and slides over the clip body 32.

Figure 7:
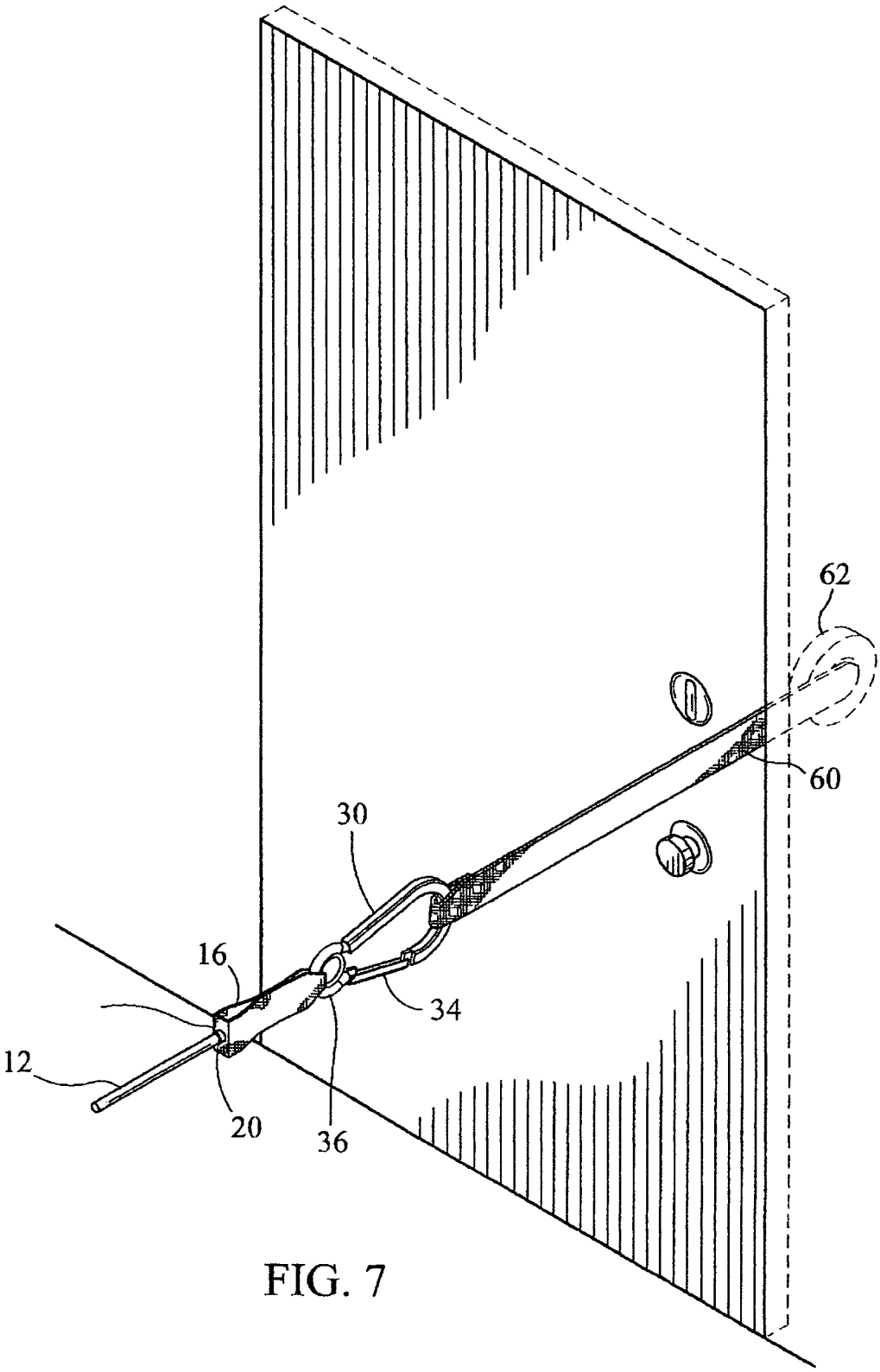
FIG. 7 is a perspective view of the resistance training exercise device with an anchor strap secured to a door in accordance with another embodiment of the instant invention.

With reference to FIG. 1-9, the resistance training exercise system 10 of the instant invention comprises a plurality of cords 12 with a tether 16 and clip 30 at each end, plurality of handles 40 and plurality of ankle or wrist straps 50, bars and, or ropes. The system 10 may comprise an anchor strap 60 with an anchor 62, as shown in FIG. 7. As shown, the anchor 62 comprises a disk secured by or mounted to the anchor end of the strap 60. Each cord 12 comprises a different level of elasticity resistance or tension force measured in pounds for facilitating various levels of resistance in accordance with desired workouts. Each cord 12 is preferably color coded to indicate the "weight" of the cord 12, which may also be set forth by indicia 31 on the clip 30. The system of the instant invention 10 may further comprise a travel bag, user manual, workout guide and, or training video or DVD.

Figure 8:
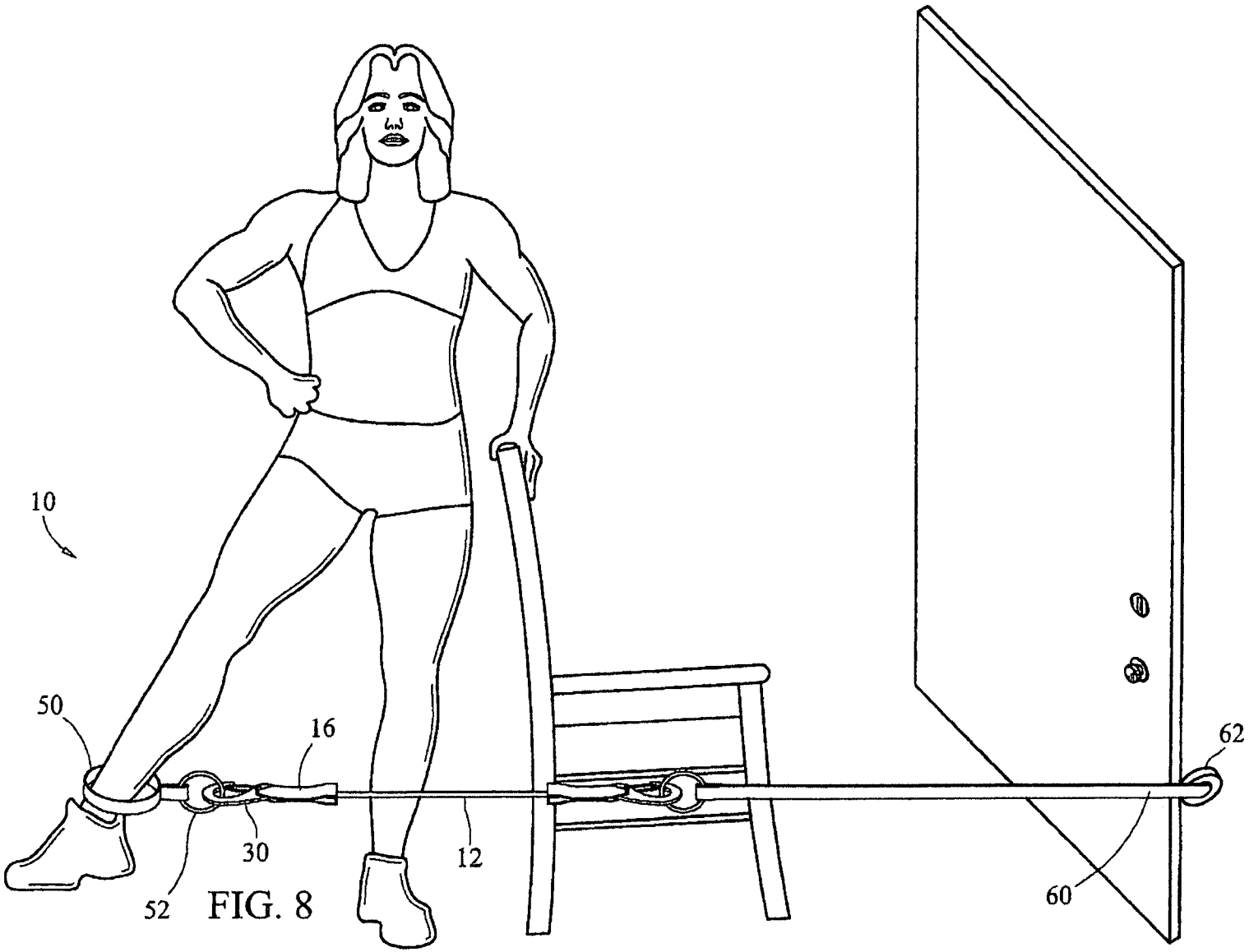
FIG. 8 is a perspective view of the resistance training exercise device with an ankle or wrist strap in use in accordance with another embodiment of the instant invention.
Figure 9:
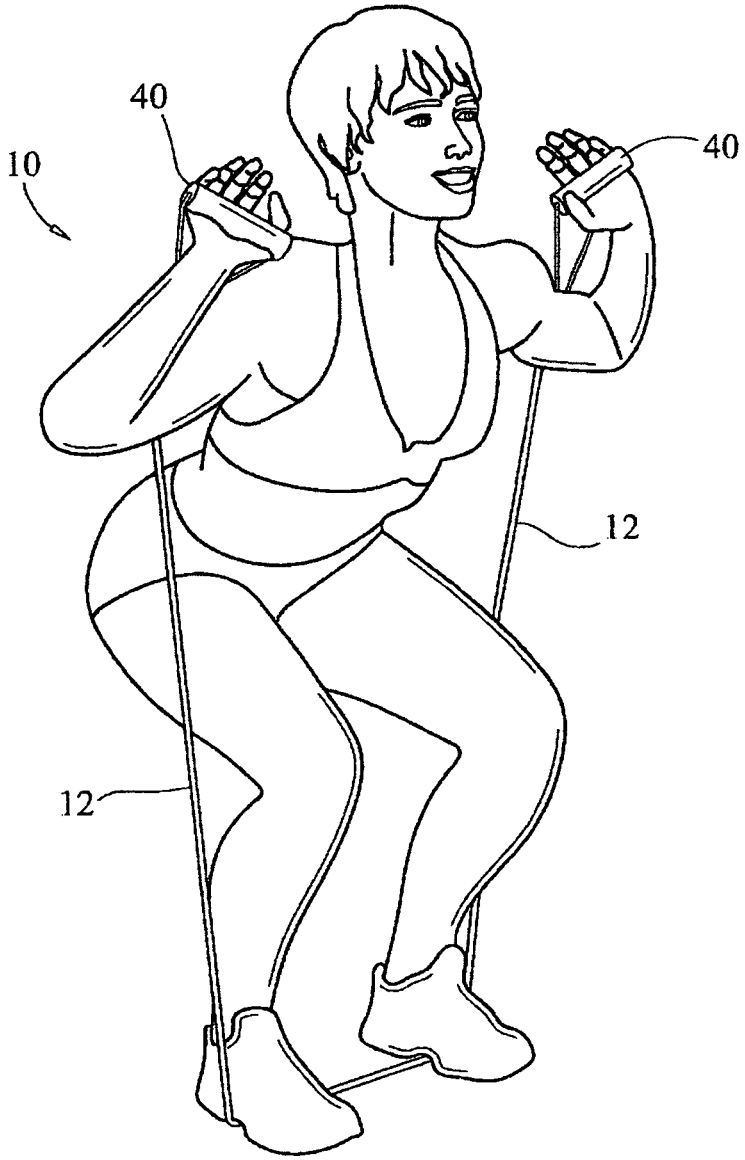
FIG. 9 is a perspective view of the resistance training exercise device with a handle in use in accordance with another embodiment of the instant invention.

With reference to FIGS. 8 and 9, the resistance training exercise method 10 of the instant invention comprises various exercises utilizing one or more cords 12 and one or more handles 40, ankle/wrist straps 50 or anchor straps 60 and anchors 62. The handles 40 are used for stretching the cord with the hands. The straps 40 are mounted to the wrists or ankles for stretching the cord. The anchor strap 60 may be mounted to a hook, door strap or door knob or to an anchor 62, as shown in FIG. 7. The user first determines the exercise to be performed. The user may reference the manual and guide for determining and designing exercise routines. Based on the exercise, the appropriately weighted cord 12 and handles 40 or straps 50 or 60 are selected and clipped to the tether 16 by the clips 30. The cord 12 may be wrapped around a secure stationary object and clipped to itself with the clip 30. The cord 12 may be threaded through a loop of a door or anchor strap 60 and to handles 40 or ankle straps 50. Once the cord 12 is properly prepared, a variety of exercises may be performed by stretching the cord and slowing the retraction of the cord so as to controllably release tension. For instance, the user may grasp a handle 40 with each hand and stretch and slowly retract the cord's 12 tension across the chest, or stand in the middle of the cord 12 and stretch the cord 12 upward and outward. The user may clip one end of the cord 12 to a door handle or hook and grasp a handle 40 at the other end with one hand while repeatedly stretching the cord 12 with a pulling motion. The user may clip one end of the cord 12 with the clip 30 to a door handle and secure a strap 50 to the other cord clip 30 at the opposite end and place it around an ankle or wrist for repeatedly stretching the cord 12 by moving the leg or arm outward. The cord 12 may be wrapped around a stationary object and secured by engaging the corresponding clip 30 with the cord 12, while a handle 40 or strap 50 is clipped at the opposite end.

With reference to FIG. 10-21C, the alternative embodiments of the instant invention 10 comprise an elastic, elongated and hollow cord 12, a tether 16 secured to each end of the cord 12, a clip 30*a* and a limit band 80 secured within the elastic cord 12 to limit the stretching of the cord 12 to a predetermined length to prevent the elastic cord 12 from breaking. The limit band 80 comprises a thin fabric or semi-elastic material having substantially less elasticity or being substantially inelastic to stop the elastic cord from stretching beyond its break point or some other predetermined stretch point limit. The limit band 80 has a higher tensile strength than the elastic cord 12 to stop the cord from stretching without the band 80 breaking. The limit band 80 preferably has some elasticity so its does not bunch up in the cord 12 when it is relaxed.

Figure 10:
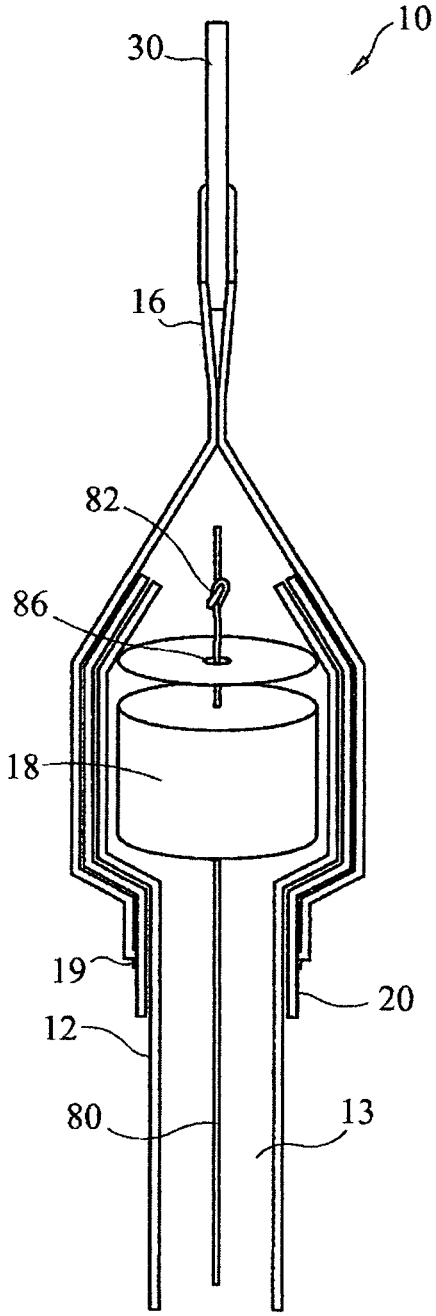
FIG. 10 is a partial cross-sectional view and perspective view of the resistance training exercise device illustrating the limit band inside the elastic cord in accordance with a further embodiment of the instant invention.

Still referring to FIG. 10-21C, the limit band 80 may be secured in the elastic band 12 through the plug 18, to the plug 18 or to a clip 30, handle 40 or loop 70. With reference to FIG. 10, the limit band 80 disposed in the cord 12 is preferably secured through the plug 18 by passing it through a channel formed in the plug 18 and tying the end of the band 80 into a knot 82 or securing it to a knob-like object. The preferred embodiment of the resistance training device 10 with a limit band 80, also comprises a metal or plastic washer 84 having a center aperture 86 through which the band 80 passes. The washer 84 provides reinforcement to the plug 18 and structural integrity and has a center aperture 86 that is smaller than the knot or knob 82. With reference to FIG. 12, in another alternative embodiment, the resistance training device 10 with a limit band 80 includes a rigid cylinder 88 in the center of the plug 18. The limit band 80 passes through the cylinder 88. The cylinder 88 reduces friction and prevents the band 80 from rubbing against the plug 18, thereby reducing wear and tear. The cylinder 88 also structurally reinforces the plug 18.

Figure 11:
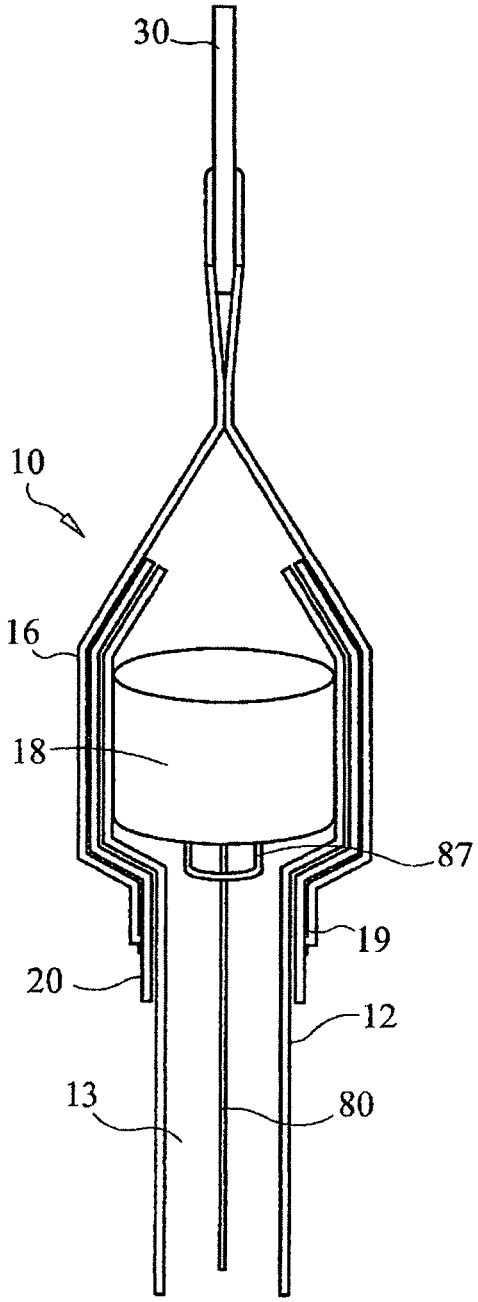
FIG. 11 is a partial cross-sectional view and perspective view of the resistance training exercise device illustrating the limit band inside the elastic cord with hook for attaching the band to the plug in accordance with another further embodiment of the instant invention.
Figure 12:
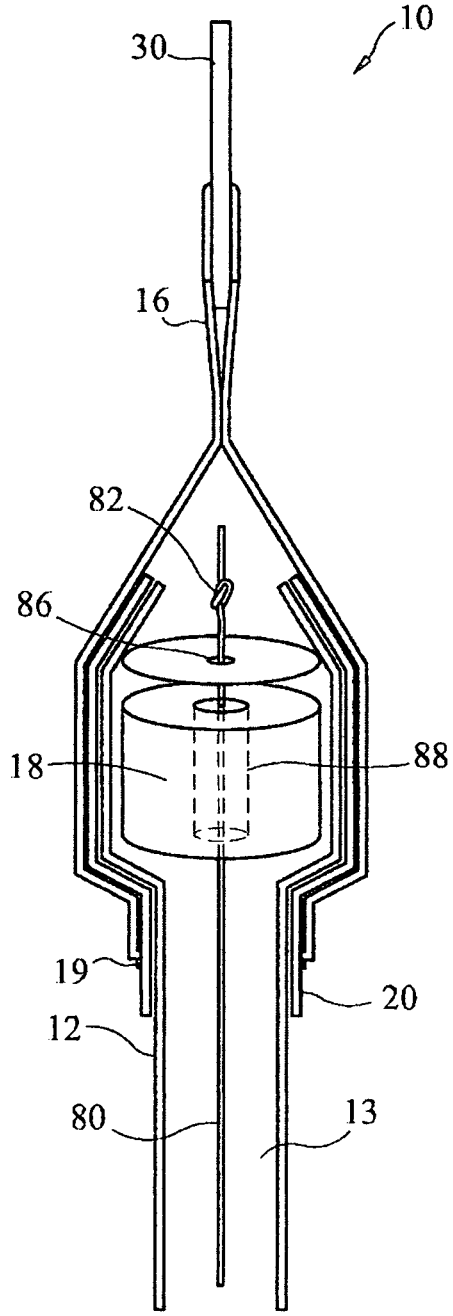
FIG. 12 is a partial cross-sectional view and perspective view of the resistance training exercise device illustrating the limit band inside the elastic cord and a protective cylinder inside the plug in accordance with yet a further embodiment of the instant invention.

With reference to FIG. 11, in another alternative embodiment, the resistance training device 10 with a limit band 80 comprises a plug 18, a hook 87 attached or secured to the bottom end of the plug 80 and a limit band 80 attached to the hook 87. The band 80 may also be attached to the plug 18. In this embodiment, the plug 18 may alternatively include a cylinder 88, as described herein.

Figure 13:
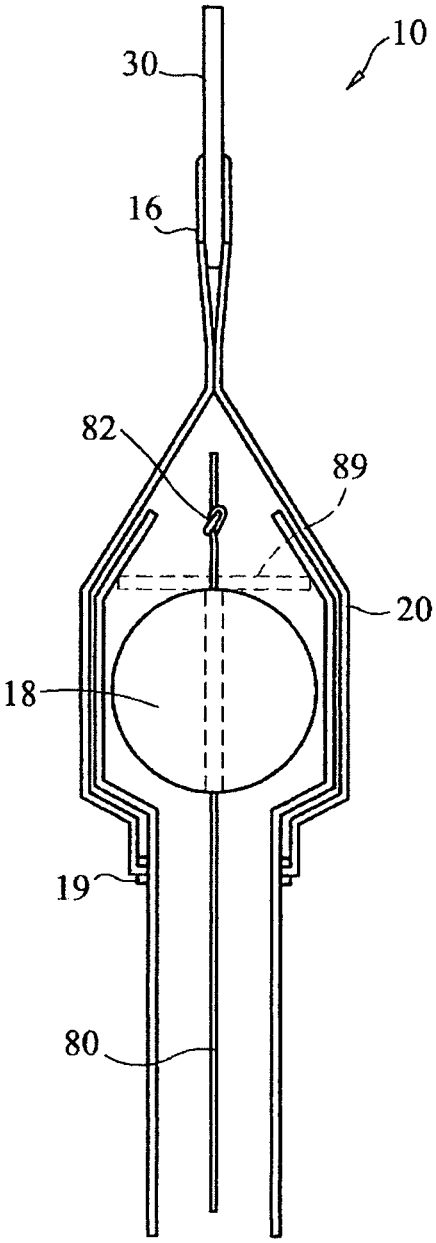
FIG. 13 is a partial cross-sectional view and elevational view of the resistance training exercise device illustrating the limit band inside the elastic cord and a ball stopper and the limit band passing through the ball in accordance with another embodiment of the instant invention.

With reference to FIG. 13, in another alternative embodiment, the resistance training device 10 with a limit band 80 comprises a spherical or spherical-like plug 18. The limit band 80 disposed in the cord 12 is secured through the spherical plug 18 by passing it through a channel formed in the plug 18 and tying the end of the band 80 into a knot 82 or securing it to a knob-like object. In this embodiment, the spherical plug 18 may alternatively include a cylinder 88 and, or washer 89, as described herein.

Figure 14:
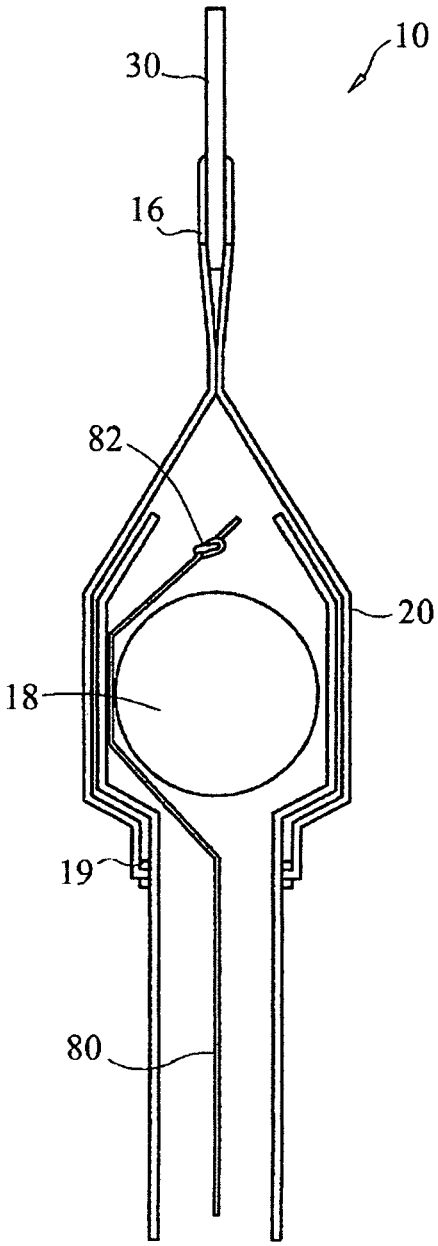
FIG. 14 is a partial cross-sectional view and elevational view of the resistance training exercise device illustrating the limit band inside the elastic cord and a ball stopper and the limit band passing around the ball in accordance with yet another embodiment of the instant invention.

With reference to FIG. 14, in another alternative embodiment, the resistance training device 10 with a limit band 80 comprises a spherical or spherical-like plug 18. The limit band 80 disposed in the cord 12 is disposed outside the spherical plug 18 and secured by tying the end of the band 80 into a knot 82 or securing it to a knob-like object. In this embodiment, the band 80 is sandwiched between the plug 18 and elastic cord 12.

Figure 15:
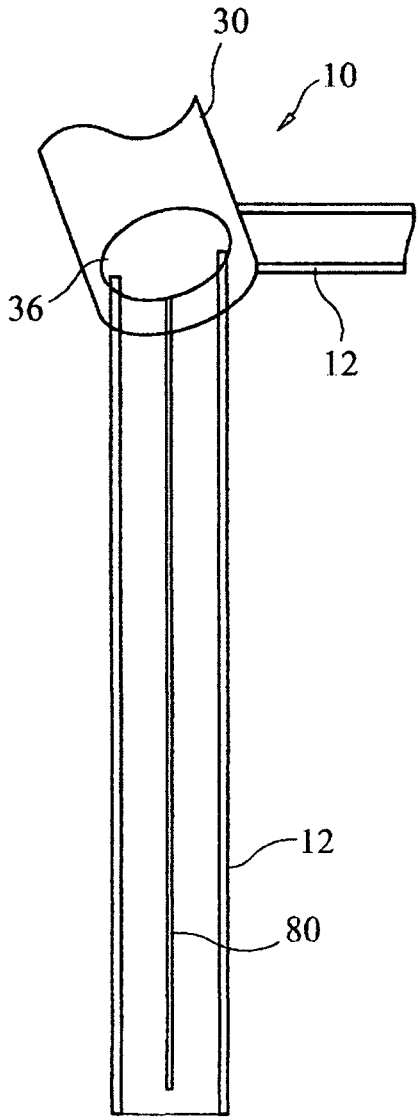
FIG. 15 is a diagram and partial elevational view of the resistance training exercise device illustrating the limit band inside the elastic cord and secured to an opening to a clip or handle in accordance with still another embodiment of the instant invention.
Figure 16:
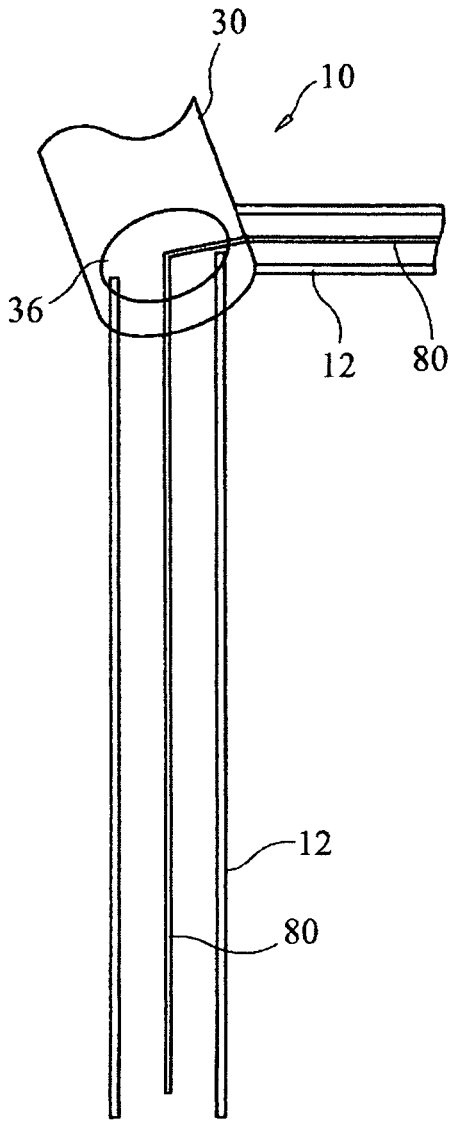
FIG. 16 is a diagram and partial elevational view of the resistance training exercise device illustrating the limit band inside the elastic cord and secured through an opening to a clip or handle in accordance with still yet another embodiment of the instant invention.

With reference to FIG. 15, in another alternative embodiment, the resistance training device 10 comprises a limit band 80 disposed in the cord 12 and secured directly to the lower end of the clip 30 and clip lower end aperture 36, handle 40 or strap 50. With reference to FIG. 16, the resistance training device comprises a limit band 80 disposed in the cord 12 and passing through the clip lower end aperture 36 for attachment to the clip 30, handle 40 or strap 50.

Figure 17:
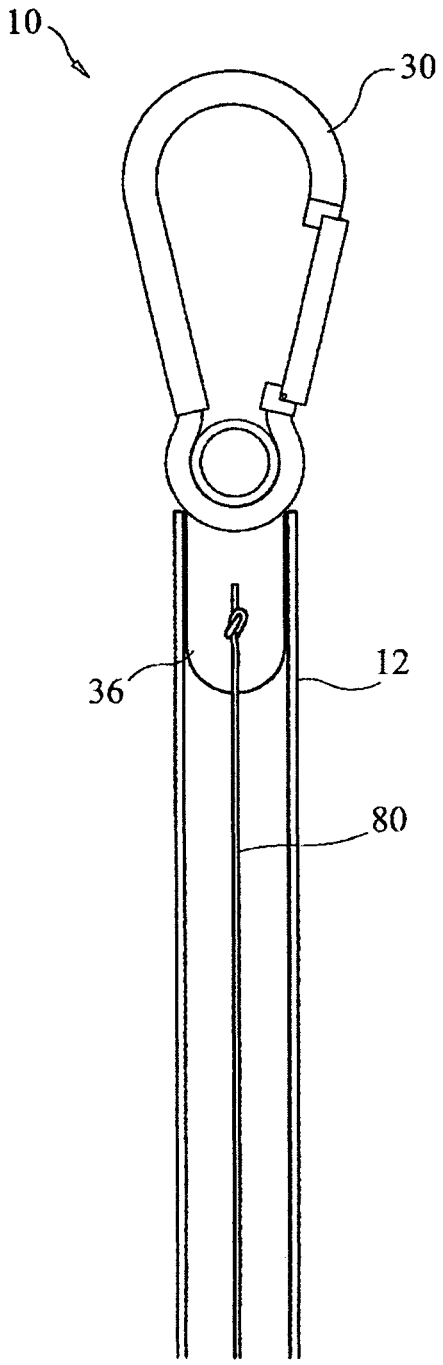
FIG. 17 is a diagram and partial elevational view of the resistance training exercise device illustrating the limit band inside the elastic cord and secured through an opening to a post of a clip in accordance with a further embodiment of the instant invention.

With reference to FIG. 17, in another alternative embodiment, the resistance training device 10 with a limit band 80 comprises a clip 30, handle 40 or strap 50 secured directly to the limit band 80. The limit band 80 disposed in the cord 12 is to the aperture 36 at the lower end of the clip 30, handle 40 or strap.

Figure 18:
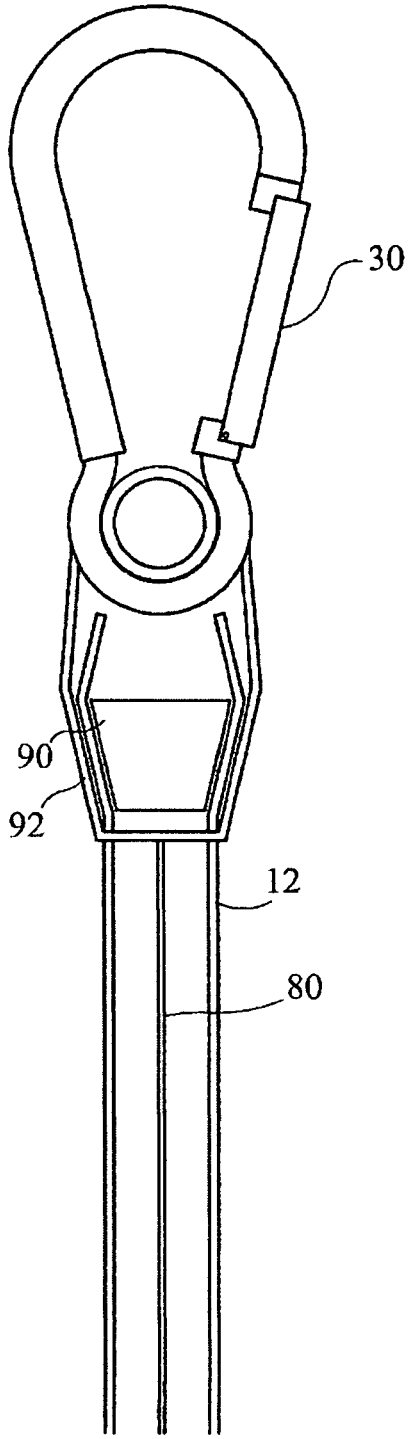
FIG. 18 is a diagram and partial elevational view of the resistance training exercise device illustrating the limit band inside the elastic cord and secured to a tapered plug in accordance with another further embodiment of the instant invention.

With reference to FIG. 18, in another alternative embodiment, the resistance training device 10 with a limit band 80 comprises a clip 30, tapered adapter 92 extending from the clip 30, tapered plug 90 disposed in the adapter 92 and limit band 80 secured to the tapered adapter 90. The elastic cord 12 penetrates the adapter 92 between the tapered plug 90 and interior walls of the adapter 92 such that the cord 12 is secured to the clip 30 within the adapter 92. In other alternative embodiments, the clip 30 may be replaced with a handle 40 or strap 50.

Figure 19:
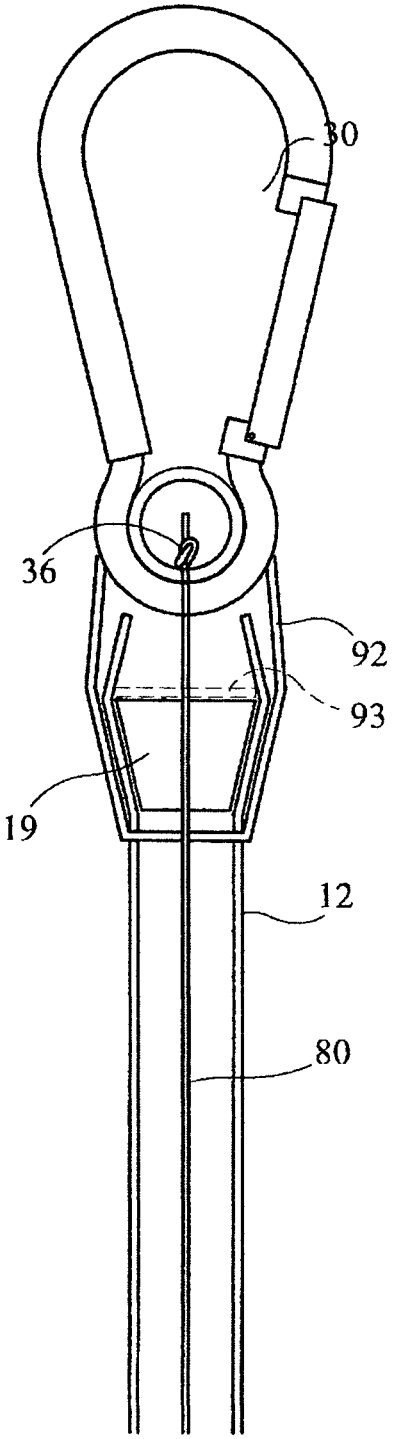
FIG. 19 is a diagram and partial elevational view of the resistance training exercise device illustrating the limit band inside the elastic cord and secured to the clip through a tapered plug in accordance with yet another further embodiment of the instant invention.
Figure 20:
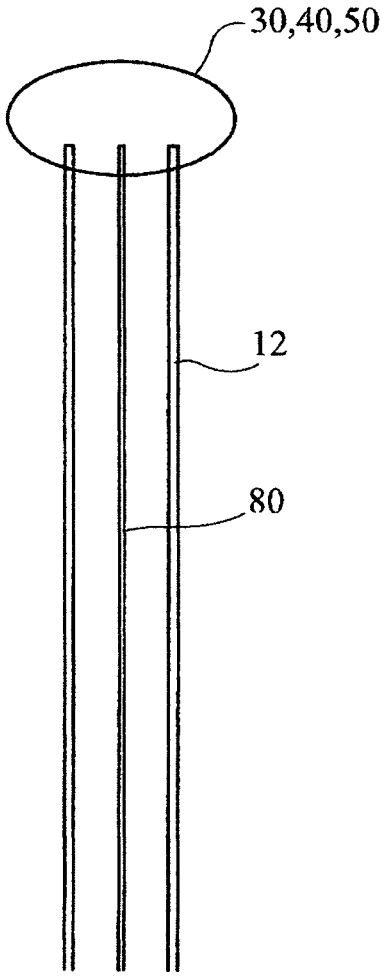
FIG. 20 is a diagram and partial elevational view of the resistance training exercise device illustrating the limit band inside the elastic cord and secured to a clip, strap or handle in accordance with still another further embodiment of the instant invention.
Figure 21C:
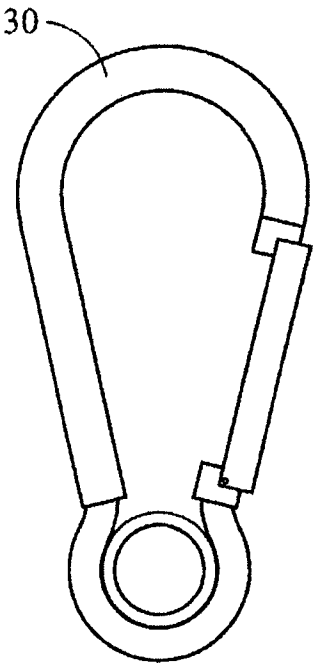
FIG. 21A-C are diagrams and partial elevational views of the handle, strap and clip used in accordance with yet still another further embodiments of the instant invention.
Figure 21B:
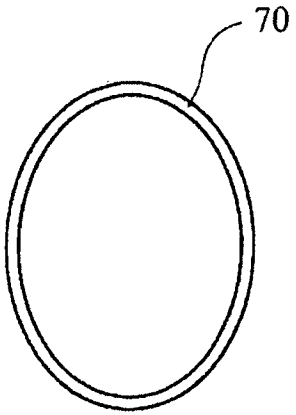
Figure 21A:
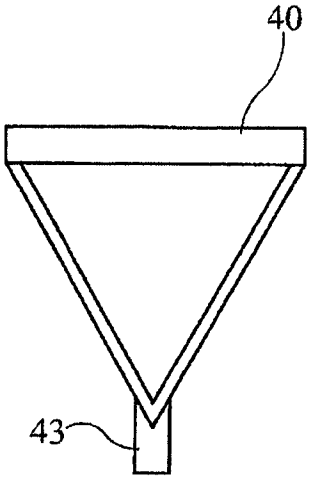

With reference to FIG. 19, in another alternative embodiment, the resistance training device 10 with a limit band 80 comprises a clip 30, tapered adapter 92 extending from the clip 30, tapered plug 90 disposed in the adapter 92 and limit band 80 passing through a channel formed in the tapered plug 92 and secured to the lower end aperture 36 of the clip 30. The elastic cord 12 penetrates the adapter 92 between the tapered plug and interior walls of the adapter 92 such that the cord 12 is secured to the clip 30 within the adapter 92. The tapered plug 90 may include a cylinder 88 passing through the center of the plug 90 to form a passage with less friction. In this embodiment, the spherical plug 18 may alternatively include a cylinder 88 and, or washer 93, as described herein. In other alternative embodiments, the clip 30 may be replaced with a handle 40 or loop 70, as depicted in FIG. 20. With reference to FIG. 21A-C, the instant invention is adapted for clips 30, handles 40 and straps 50.

Figure 22B:
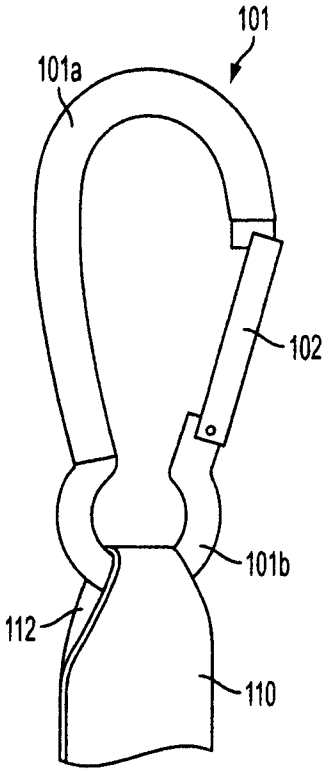
FIG. 22A-B are frontal views of another embodiment of the device of the present invention showing a carabineer and the second compartment of the tether attached to said carabineer.
Figure 22A:
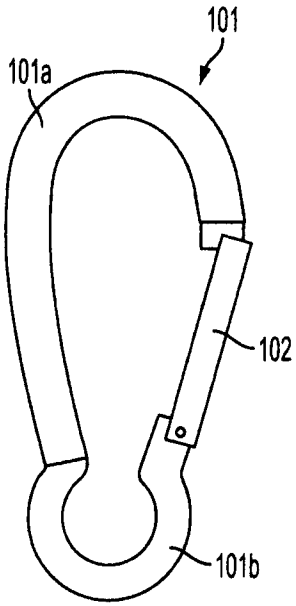

As shown in FIGS. 3-4 and now referring now to FIGS. 22A-B, another embodiment of the device of the present invention comprises a carabineer 101 with a top portion 101*a* and a bottom portion 101*b* and a movable gate element 102. At least a portion of the second compartment 112 of the tether 110 is attached to the bottom portion 101*b* of the carabineer 101.

Figure 23:
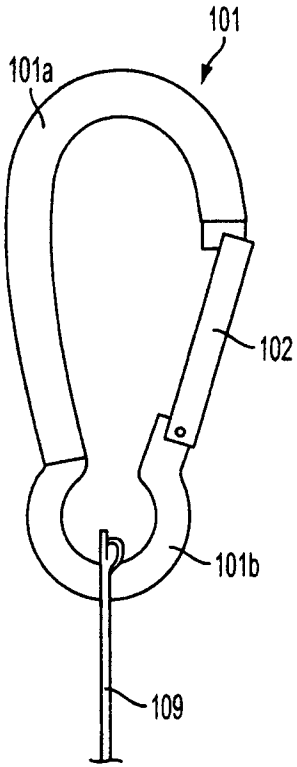
FIG. 23 is a frontal view of the carabineer of FIG. 22 with the limit band.

FIG. 23 depicts a limit band 109 attached to the bottom portion 101*b* of the carabineer 101.

Figure 25:
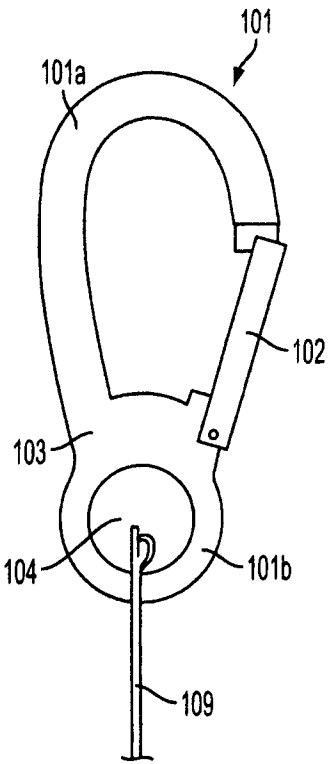
FIG. 25 is a frontal view of the carabineer of FIG. 24 with the limit band.
Figure 24B:
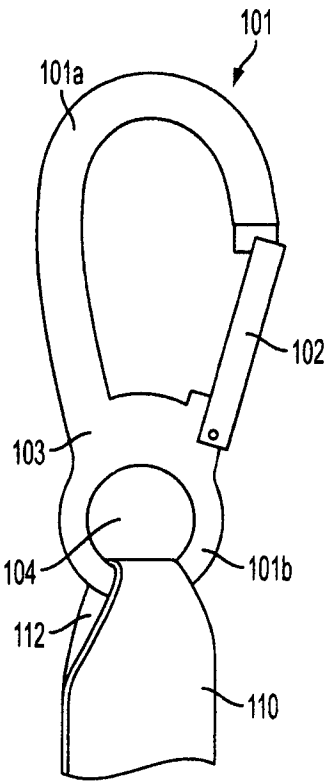
FIGS. 24A-B are frontal views of another further embodiment of the device with a carabineer with a closed area or compartment and the second compartment of the tether attached to said carabineer.
Figure 24A:
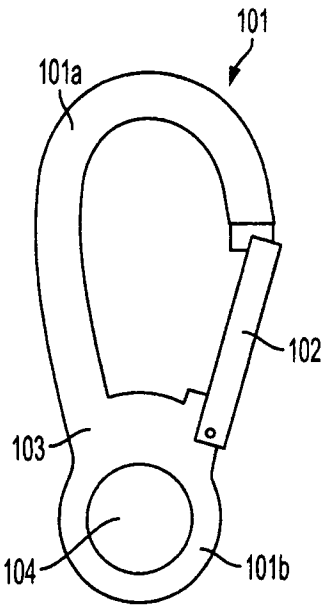

Referring now to FIGS. 24A-B, a further embodiment of the device of the present invention comprises a carabineer 101 with a top portion 101*a* and a bottom portion 101*b* and a movable gate element 102. The bottom portion 101*b* has a closed compartment or area 103 forming an aperture 104. At least a portion of the second compartment 112 of the tether 110 is situated within the aperture 104 of the closed area 103 of the bottom portion 101*b* of the carabineer 101. FIG. 25 depicts a limit band 109 attached to the closed area or compartment 103 of the bottom portion 101*b* of the carabineer 101.

Figure 26:
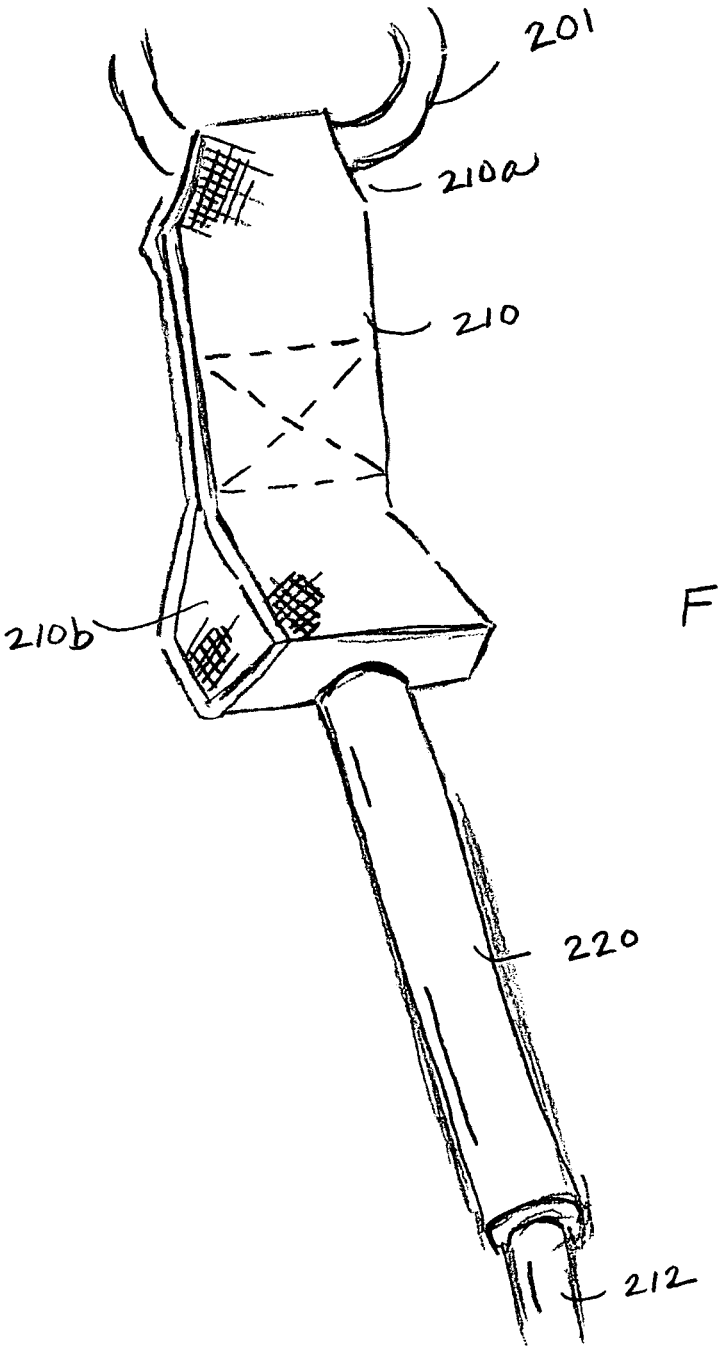
FIG. 26 is a perspective view of the extensive sleeve grip embodiment.

FIG. 26 is a perspective view of one of the embodiments of the invention showing the tether 210 with compartments, 210*a* and 210*b* respectively. At least a portion of an attachment device 201 is attached to a portion of the compartment 210*a*. At least a portion of the sleeve 220, cord 212 and the plug (not shown) is situated within a portion of the compartment 210*b*. The sleeve 212 is extended so that it may function as a handle or grip. The sleeve 212 may have a pattern or design on its external surface to assist with its gripping function.

Figure 28:
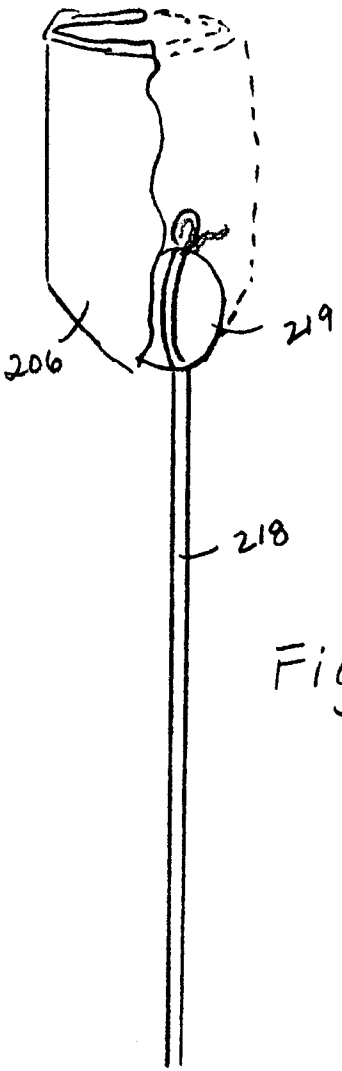
FIG. 28 is a cross section view of the plug with the limit band and attached ball.
Figure 27:
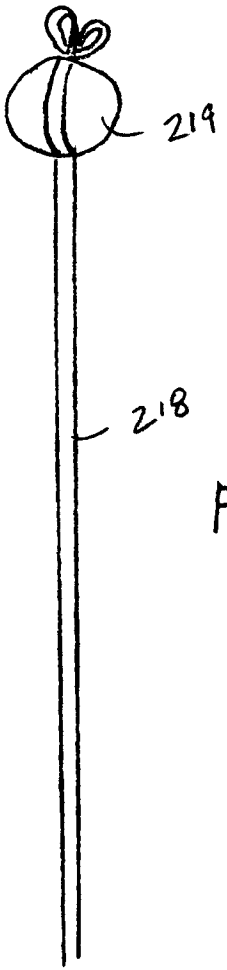
FIG. 27 is a side view of the limit band and ball embodiment.

FIGS. 27 and 28 illustrate the limit band 218 attached to a ball 219 and as shown in FIG. 28, at least a portion of the ball 219 with the attached limit band 218 is situated with the plug 206.

Numerous modifications and variations of the present invention are possible in light of the above teachings. It is therefore to be understood that within the scope of the attendant claims attached hereto, this invention may be practiced otherwise than as specifically disclosed herein.

What is claimed is:

1. An exercise apparatus comprising:

a stretchable cord having opposing first and second ends, said cord having a solid, peripheral wall providing an internal cavity, said peripheral wall having a continuous, solid external surface;

at least two plugs, each plug being inserted within said internal cavity of said cord adjacent said first and second ends of said cord;

at least two sleeves, each of said sleeves being placed over said external surface of said cord adjacent said first and second ends of said cord, each of said plugs being situated within a length of each of said sleeves;

at least two tethers, each tether forming at least two compartments, a first compartment of each of said tethers receives at least one end of said cord with at least a portion of said sleeve and at least a portion of said plug;

at least one limit band situated within said internal cavity of said cord said at least one limit band including opposed end segments extending into first compartments of said at least two tethers, each end segment cooperating with an adjacent plug and being retained by said plug for movement with said plug when said cord is being stretched; and at least two attachment devices, at least a portion of each said attachment devices is designed for receiving at least a portion of a second compartment of each of said tethers.

2. The apparatus of claim 1 wherein said first and second compartments of said tether are formed by a stitched portion.

3. The apparatus of claim 1 wherein each of said first compartments of said tether forms a loop, each of said loops is placed within each of said defined area of said attachment device.

4. The apparatus of claim 1 wherein said attachment device is selected from a group consisting essentially of hooks, crabclaws, carabineers, clamps and combinations thereof.

5. The apparatus of claim 1 wherein said sleeve, said tether with said compartments and said plug assist in preventing said cord from breaking and snapping during stretching of said cord, said plug comprising at least one ball cooperating with and retaining an end segment of said at least one limit band.

6. The apparatus of claim 1 wherein said first compartment of each of said tethers comprises at least one aperture, said plug is situated within said first compartment of said tether and prevents said end of said cord and at least a portion of said sleeve from passing said aperture when said cord is stretched.

7. The apparatus of claim 1 wherein said attachment device has a defined area for receiving a portion of said second compartment of said tether.

8. The apparatus of claim 6 wherein said aperture of said tether is reinforced.

9. The apparatus of claim 1 further comprises a supplemental apparatus designed to be attached to said attachment device for providing multiple exercise options, said supplemental apparatus being selected from a group consisting essentially of handles, loops, straps, bands, rings, rope, grips and combinations thereof.

10. The apparatus of claim 1 wherein said tether comprises straps.

11. The apparatus of claim 1 further comprising a plurality of combinable devices to form a system.

12. The apparatus of claim 1, wherein said at least two sleeves are folded over end portions of said cord.

* * * * *